US005768969A

United States Patent [19]

Dalfiume

[11] Patent Number: 5,768,969

[45] Date of Patent: Jun. 23, 1998

[54] PERFORATING KNIFE

[75] Inventor: Attilio Dalfiume, San Lazzaro Di Savena, Italy

[73] Assignee: Koenig & Bauer-Albert Aktiengesellschaft, Wurzburg, Germany

[21] Appl. No.: 523,437

[22] Filed: Sep. 5, 1995

[30] Foreign Application Priority Data

Sep. 6, 1994 [DE] Germany ..... 44 31 645.3

[51] Int. Cl.[6] ..... B42D 13/00; B26F 1/02; B26F 1/20; B41F 13/54

[52] U.S. Cl. ..... 83/660; 83/660; 83/848; 83/698.41; 493/303; 493/369; 493/370

[58] Field of Search ..... 83/660, 835, 848, 83/330, 332, 333, 698.51, 698.41, 620, 618, 954, 698 A; 493/437, 63, 73, 353, 363, 371, 372, 370, 369, 340

[56] References Cited

U.S. PATENT DOCUMENTS

| | | | |
|---|---|---|---|
| 835,226 | 6/1906 | Oakes | 83/848 |
| 853,255 | 5/1907 | Miller | 83/848 |
| 2,176,815 | 10/1939 | Hiroashi . | |
| 2,458,867 | 1/1949 | Messersmith . | |
| 2,682,306 | 6/1954 | Schriber . | |
| 2,956,465 | 5/1960 | Mingo | 83/660 |
| 3,205,750 | 9/1965 | Strange | 493/63 |
| 3,228,710 | 1/1966 | Chodorowski . | |
| 3,255,648 | 6/1966 | Buttery | 493/63 |
| 3,463,039 | 8/1969 | Silver . | |
| 3,841,189 | 10/1974 | Spengler | 83/660 |
| 4,358,979 | 11/1982 | Kursbuch | 83/658 |
| 4,620,467 | 11/1986 | Margraf | 83/389 |
| 4,727,788 | 3/1988 | Yoshida | 83/848 |
| 4,745,835 | 5/1988 | Schnitzer | 83/678 |
| 4,852,442 | 8/1989 | Pottorff | 83/697 |
| 4,951,967 | 8/1990 | Michalik | 281/2 |
| 5,001,956 | 3/1991 | Ntisch | 83/620 |

FOREIGN PATENT DOCUMENTS

| | | |
|---|---|---|
| 0 307 891 | 1/1990 | European Pat. Off. . |
| 0 364 864 | 4/1990 | European Pat. Off. . |
| 2 234 078 | 1/1973 | Germany . |

*Primary Examiner*—Joseph J. Hail, III
*Assistant Examiner*—Christopher Day
*Attorney, Agent, or Firm*—Jones, Tullar & Cooper, P.C.

[57] ABSTRACT

A signature perforating knife that is useable to perforate multi-layer signatures is formed as a compound knife using either several knife blades or a combination of knife blades and spacer blades. Each compound perforating knife has a uniform base thickness. The specific characteristics of the compound perforating knife can be adapted in accordance with the weight of the paper web being printed and the number of layers of the multi-layer signature which will be perforated and then folded in a folding apparatus of a web-fed rotary printing press.

2 Claims, 3 Drawing Sheets

PERFORATING KNIFE

FIELD OF THE INVENTION

The present invention is directed generally to a perforating knife. More specifically, the present invention is directed to a signature perforating knife. Most particularly, the present invention is directed to a compound knife for perforating multi-layer signatures prior to folding of the signatures. The compound perforating knife is a combination of knife blades and spacer blades. The compound knife has an overall base thickness which stays the same regardless of the specific combination of knife blades and spacer blades used. The knife blades used have several thicknesses and different arrangements of teeth. The several knife blades can be arranged in different combinations in accordance with the type of perforation desired to be produced in the multi-layer signature.

DESCRIPTION OF THE PRIOR ART

In the production of various printed products, it is very well known to arrange a plurality of different printed sheets atop each other and to then fold this stack of sheets, which are typically referred to as a signature, into a folded signature which may then be combined with other folded signatures. When the multi-layer signature is folded along a fold line, there have often been problems resulting from the production of creases, wrinkles, web or sheet tears and the like which occur along the fold line.

One method and apparatus for producing multi-layer signatures which are then folded along a fold line, and which eliminates the occurrence of creases or wrinkles at the cutting point of the fold line is described in East German Patent Publication DT 2 234 078. In this prior art publication, it is taught that a plurality of slits or perforations can be made, which extend in the linear direction of the fold line. These slits or perforations can be made by using a perforating knife. Once these slits or perforations have been made by the perforating knife, the multi-layer signature can be folded along the linear fold line which has been provided with the slits or perforations.

The limitation of this prior art method and apparatus is that the thickness of the perforating knife being used varies as a function of the weight, thickness, or density of each paper web in the multi-layer signature, as well as the number of layers of webs in the signature. A relatively light weight or thin paper web which is collected to form a multi-layer signature having relatively few layers will require a perforating knife having a thickness which is less than would be required to perforate a multi-layer signature having a relatively large number of layers with each paper web being relatively thick or heavy. This requires the provision of a plurality of different signature perforating knives, each one of which is suited for use within a relatively narrow range of paper web weights or thicknesses and numbers of web layers in a multi-layer signature. The folding apparatus must therefore be provided with a wide range of perforating knives having various thicknesses and tooth arrangements. Even then, a new multi-layer signature may require a different knife structure.

It will be seen that this prior art requirement for a plurality of different perforating knives creates a burden. It is thus apparent that a need exists for a perforating knife that overcomes this problem. The signature perforating knife in accordance with the present invention provides such a device and is a significant improvement over the prior art.

SUMMARY OF THE INVENTION

It is an object of the present invention to provide a perforating knife.

Another object of the present invention is to provide a signature perforating knife.

A further object of the present invention is to provide a compound knife for perforating multi-layer signatures.

Still another object of the present invention is to provide a signature perforating knife composed of at least one knife blade and one spacer blade.

Yet a further object of the present invention is to provide a compound signature perforating knife having a constant base thickness.

Even still another object of the present invention is to provide a compound perforating knife using half length blades.

As will be described in the detailed description of the preferred embodiments, which is presented subsequently, the perforating knife in accordance with the present invention is a compound knife that is composed of at least one knife blade together with other knife blades or of a combination of knife blades and spacer blades. There are provided several different knife blades of varying tooth characteristics, thicknesses, and lengths. There are also provided several different spacer blades of different thicknesses. These knife blades and spacer blades can be combined in a variety of combinations depending on the weight or density of the individual paper webs, the number of layers in the multi-layer signature, and the type of slit or perforations to be formed along the linear fold line.

The perforating knife in accordance with the present invention greatly reduces the number of blades that must be maintained to be able to accommodate the wide variety of multi-layer signatures and paper web weights which are typically encountered in a printing plant. A suitable signature perforating knife can be provided by the appropriate combination of several knife blades or of one or more knife blades with one or more spacer blades. The base thickness of the resultant compound blade will always be the same so that there are not required any modifications to be made to the blade holder on the perforating blade cylinder. If desired, the knife blades can be provided in half cylinder lengths so that the resultant compound blade can be symmetrical about a vertical center line. Such a blade arrangement may be beneficial if a certain perforation pattern is to be imparted to the multi-layer signature.

The compound knife for perforating multi-layer signatures in accordance with the present invention overcomes the limitations of the prior art. It is a substantial advance in the art.

BRIEF DESCRIPTION OF THE DRAWINGS

While the novel features of the perforating knife in accordance with the present invention are set forth with particularity in the appended claims, a full and complete understanding of the invention may be had by referring to the detailed description of the preferred embodiments which is presented subsequently, and as illustrated in the accompanying drawings, in which:

DETAILED DESCRIPTION OF THE PREFERRED EMBODIMENTS

Figure 1:
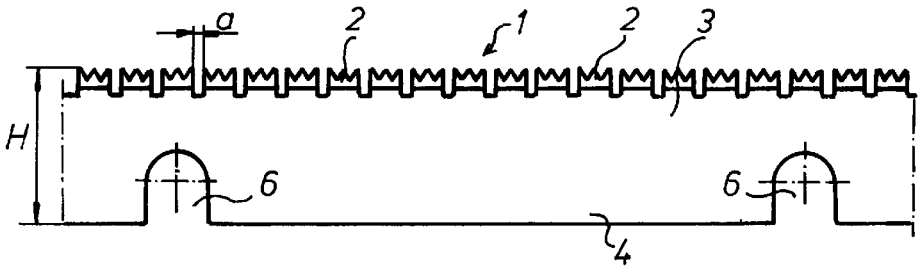
FIG. 1 is a front elevation view of a first preferred embodiment of a knife blade in accordance with the present invention.
Figure 3:
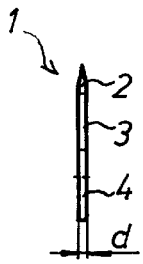
FIG. 3 is an end view of the knife blade of FIG. 1.
Figure 2:
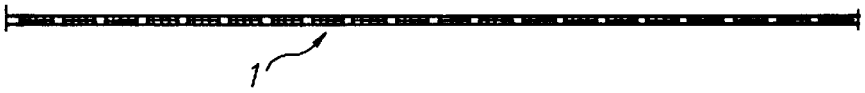
FIG. 2 is a top plan view of the knife blade of FIG. 1.

Referring initially to FIGS. 1–3, there may be seen generally at 1, a first preferred embodiment of a knife blade that is usable in the compound perforating knife in accordance with the present invention. Knife blade 1 has a thickness "d" of 1 mm, as may be seen most clearly in FIG. 3 and has a total height "H". A plurality of paper web perforating teeth 2 are provided along a first or an upper side or edge 3 of the knife blade 1. Each tooth or tooth groups 2 is separated from its adjacent tooth or tooth groups 2 by a clear or unobstructed spacing distance "a" which may be, for example 1.5 mm. Each tooth or tooth group 2 may be ground at their tops to have a length which may be, for example, three times the spacing distance "a" between the adjacent teeth or tooth groups 2. A second or lower edge or side 4 of the knife blade 1 has a plurality of recesses 6 which are spaced along the length of the knife blade 1. These recesses 6 allow the knife blade 1 to be mounted, in a height adjustable manner, in a suitable perforating knife receiving receptacle in a perforating knife cylinder which is not depicted in the drawings since it is generally conventional and forms no part of the current invention. One possible arrangement of perforating knives in a receptacle of a perforating cylinder is illustrated in European Patent Publication EPO 307891 B1.

Figure 4:
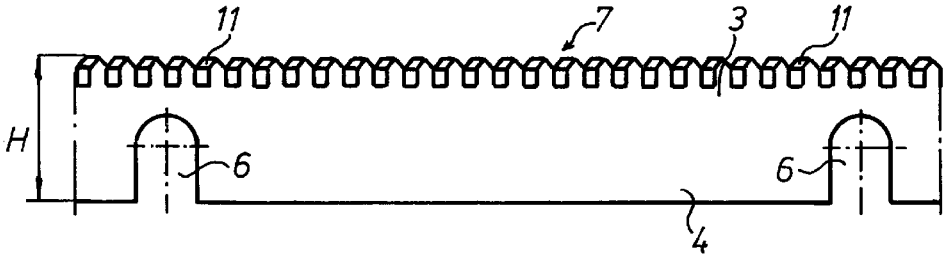
FIG. 4 is a front elevation view of a second preferred embodiment of a knife blade in accordance with the present invention.
Figure 6:
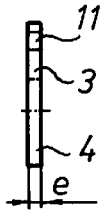
FIG. 6 is an end view of the knife blade of FIG. 4.
Figure 5:
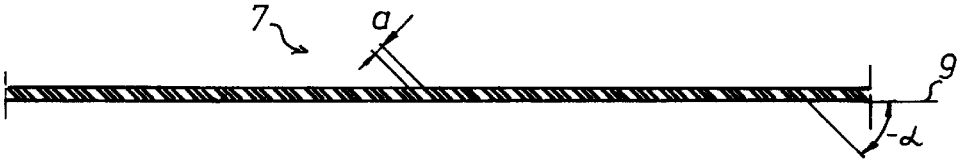
FIG. 5 is a top plan view of the knife blade of FIG. 4.

Referring now to FIGS. 4–6, there may be seen, generally at 7, a second preferred embodiment of a knife blade for use in the compound perforating knife in accordance with the present invention. This second knife blade 7 has a thickness "e" of, for example, 2 mm and has a total length H which is the same as the total blade height H of the first knife blade 1. This second knife blade 7 has a plurality of perforating teeth 11 on its upper edge 3 with there teeth 11 each being spaced from each other by a distance "a". As may be seen most clearly in FIG. 5, these teeth 11 are angled at an angle of $-\alpha$of for example 45° with respect to a longitudinal linear axis 9. These teeth 11 are thus referred to as negatively angled teeth. Each perforating tooth 11 can have a tooth length which corresponds to the clear spacing distance "a" between adjacent teeth 11. The second or lower side 4 of the second knife blade 7 is also provided with suitably spaced recesses 6, as has already been discussed in connection with knife blade 1.

Figure 7:
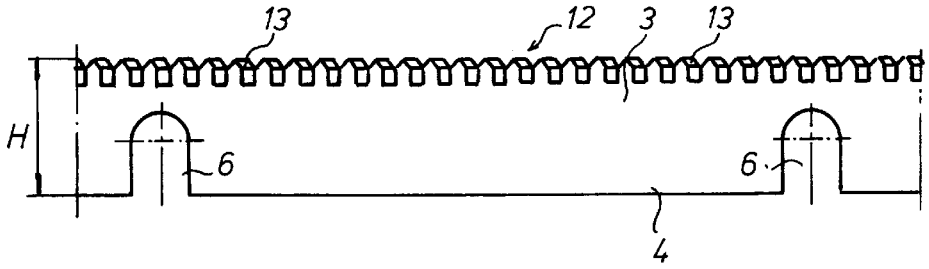
FIG. 7 is a front elevation view of a third preferred embodiment of a knife blade in accordance with the present invention.
Figure 9:
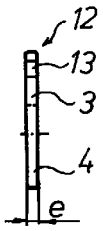
FIG. 9 is an end view of the knife blade of FIG. 7.
Figure 8:
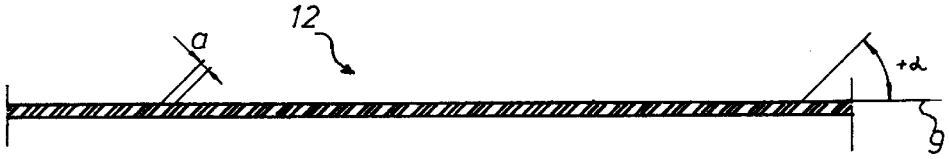
FIG. 8 is a top plan view of the knife blade of FIG. 7.

Turning now to FIGS. 7–9, there may be seen, generally at 12, a third preferred embodiment of a knife blade for a compound signature perforating knife in accordance with the present invention. This third knife blade 12 is generally similar to knife blade 7 in thickness, height and length. The primary difference between the two is that, as may be seen most clearly in FIG. 8, the perforating teeth 13 are positive teeth since they are angled at a $+\alpha$ angle of generally 45° degrees with respect to the horizontal linear line 9.

Figure 10:
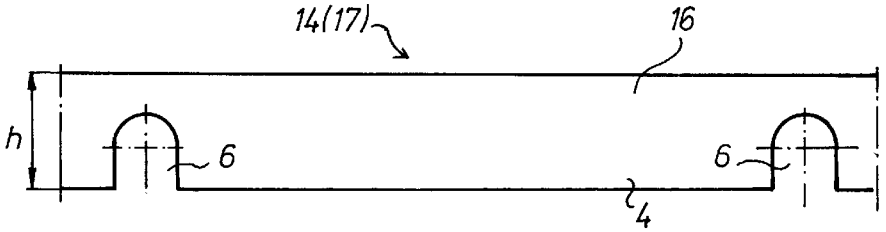
FIG. 10 is a front elevation view of a preferred embodiment of a spacer blade in accordance with the present invention.
Figure 12:
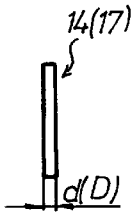
FIG. 12 is an end view of the spacer blade of FIG. 10.
Figure 11:
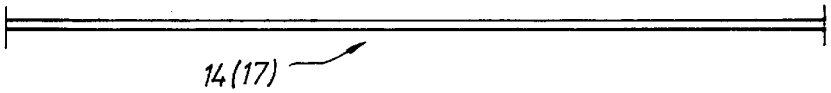
FIG. 11 is a top plan view of the spacer blade of FIG. 10.

Now turning to FIGS. 10–12 there may be seen a first preferred embodiment of a spacer blade, generally at 14 in accordance with the present invention. Spacer blade 14 has a thickness "d" of, for example 1 mm, as may be seen most clearly in FIG. 12, and has a height "h" which is less than the height H of each of the preferred embodiments of the knife blades 1, 7 and 12. The upper or first surface or edge 16 of the spacer blade 14 is smooth and does not have any teeth. The second or lower side 9 of the spacer blade 14 is provided with spaced recesses 6, as was the case with the three knife blades 1, 7 and 12, which were discussed in detail previously.

A second preferred embodiment of a spacer blade, generally at 17, is also shown in FIGS. 10–12. The only difference between the two spacer blade embodiments is that in the second spacer blade embodiment 17, the blade has a thickness "e" which is twice the thickness "d" of the first spacer blade 14. Thus there may be provided a thin spacer blade 14 and a thick spacer blade 17.

Turning now to FIGS. 13–24 there may be seen six preferred embodiments of compound perforating knives in accordance with the present invention. Each compound perforating knife is similar in that it includes at least one knife blade 1, 7 or 12 and at least one spacer blade, or a plurality of knife blades. In each instance, the resulting compound perforating knife has an overall base thickness D which is twice "e" plus "d". This overall base thickness D is a constant with any compound perforating knife so that each such knife will be received in the receptacle of the perforating cylinder. The ability of the perforating knife of the present invention to be compounded from either one or more blades 1, 7 or 12 or one or more blades and at least one spacer blade 14 or 17 affords a high degree of flexibility while still requiring the stocking of only a relatively few individual components.

Figure 13:
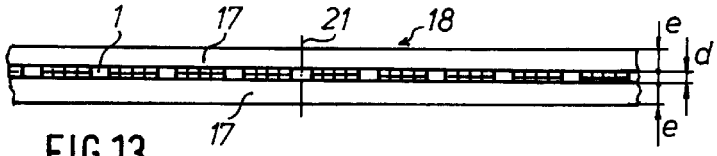
FIG. 13 is a top plan view of a first preferred embodiment of a perforating knife in accordance with the present invention.
Figure 14:
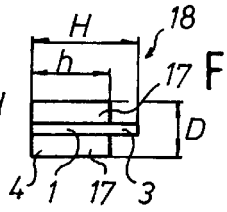
FIG. 14 is an end view of the perforating knife of FIG. 13.

Referring now specifically to FIGS. 13 and 14, there may be seen a first preferred embodiment of a compound perforating knife, generally at 18 in accordance with the present invention. Perforating knife 18 consists of a centrally disposed knife blade 1 having a height H and a thickness "d", and of two thick spacer blades 17, each of which has a height "h" and a thickness "e". The two thick spacer blades 17 sandwich the knife blade 1. The resultant compound perforating knife 18 has an overall base thickness D, as will all of the compound perforating knives, and a length which corresponds to the receptacle length in the perforating cylinder which will receive each selected compound perforating knife 18, 19, 22, 23, 26 or 27.

Figure 15:
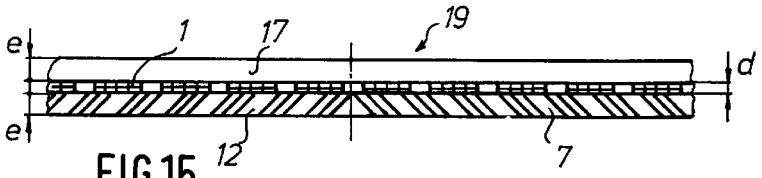
FIG. 15 is a top plan view of a second preferred embodiment of a perforating knife in accordance with the present invention.
Figure 16:
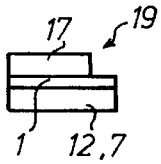
FIG. 16 is an end view of the perforating knife of FIG. 15.

A second preferred compound perforating knife is shown, generally at 19, in FIG. 15 and 16. This second knife 19 utilizes one thin knife blade 1, one thick knife blade 12 with positive teeth of half length, one thick knife blade with negative teeth 7 of half length, and one thick spacer blade 17 of full length. The two half length knife blades 7 and 12 abut each other at a vertical center line 21 and their teeth 11 and 13 are mirror images. In this arrangement, the spacer blade 17 is first in the direction of rotation. The relative heights of the spacer blade 17 and of the knife blades 1, 7 and 12 are depicted in FIG. 16, as are the relative blade thicknesses. These thicknesses and heights have been described previously and will not be discussed for each compound perforating knife. It will be again understood that each compound perforating knife has an overall base thickness D which is the sum of two times the thickness "e" plus one time the thickness "d". It will again be understood that all of the knife blades have a height H which is greater than the height "h" of either of the spacer blades 14 or 17.

Figure 17:
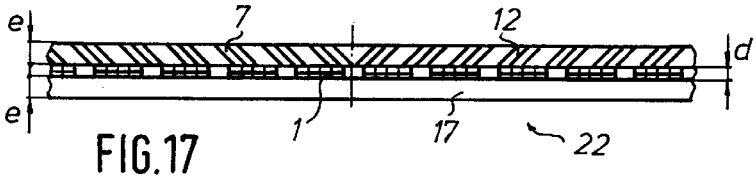
FIG. 17 is a top plan view of a third preferred embodiment of a perforating knife in accordance with the present invention.
Figure 18:
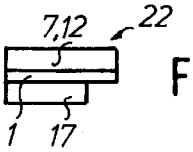
FIG. 18 is an end view of the perforating knife of FIG. 17.

A third preferred embodiment of a compound perforating knife 22 is depicted in FIGS. 17 and 18. This third knife 22 is essentially the second knife 19 rotated 180 degrees about a central axis. This means that the negative tooth blade knife 7 of half length is at the upper left, the positive tooth blade 12 of half length is at the upper right, the thin tooth blade 1 of full length is in the middle, and the thick spacer blade 17 of full length is at the bottom, all as seen in FIG. 17.

Figure 19:
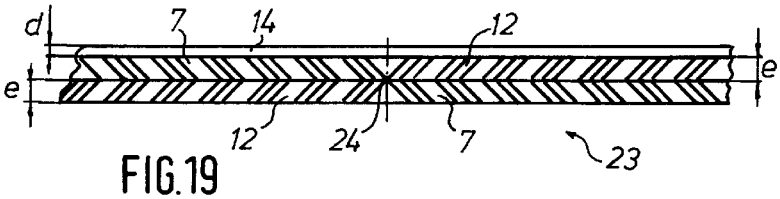
FIG. 19 is a top plan view of a fourth preferred embodiment of a perforating knife in accordance with the present invention.
Figure 20:
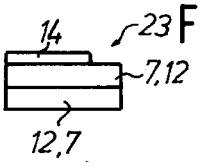
FIG. 20 is an end view of the perforating knife of FIG. 19.
Figure 21:
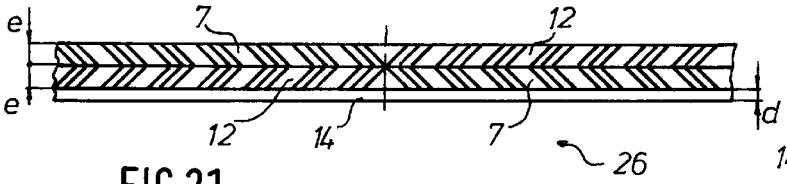
FIG. 21 is a top plan view of a fifth preferred embodiment of a perforating knife in accordance with the present invention.

Turning now to FIGS. 19 and 21 there is shown a full herringbone blade with an upper thin spacer, generally at 23. The thin full length spacer 14 is first or upper most and is followed by a first full length blade comprised of a left negative tooth blade 7 of half length and a right position tooth blade 12 of half length. This is followed by a second full length blade comprised of a left positive knife blade 12 of half length and a right negative knife blade 7 of half length. The herringbone blade is a mirror image about the vertical center line 21 with the vertices 24 of the cooperating positive and negative teeth pointing toward this centerline 21.

Figure 22:
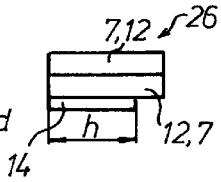
FIG. 22 is an end view of the perforating knife of FIG. 21.

A fifth preferred embodiment of a compound perforating knife in accordance with the present invention is shown generally at 26 in FIGS. 21 and 22. This knife 26 is essentially knife 23 again rotated about 180 degrees about a central vertical axis. In this fifth embodiment, the thin spacer blade 14 is positioned at the bottom or on the lower outside of the four half length positive and negative tooth blade segments 7 and 12 which cooperate to form the full herringbone pattern.

Figure 23:
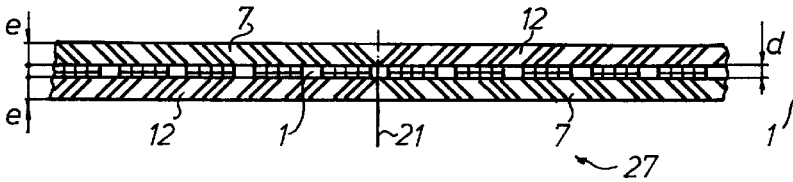
FIG. 23 is a top plan view of a sixth preferred embodiment of a perforating knife in accordance with the present invention.
Figure 24:
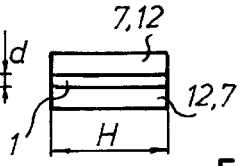
FIG. 24 is an end view of the perforating knife of FIG. 23.

Referring now to FIGS. 23 and 24, there may be seen, generally at 27, a sixth preferred embodiment of a compound perforating knife in accordance with the present invention. This sixth perforating knife 27 is compounded entirely of knife blades 1 , 7 and 12 and does not have any spacer blades 14 or 17. A thin knife blade 1 of full length is placed in the center of the compound blade 27. The first or upper sandwich layer is formed by a left, negative tooth blade 7 of half length and a right positive tooth blade 12 of half length. The lower sandwich half is the inverse of the above and is formed of a left positive tooth blade 12 of half length and a right negative tooth blade 7 of half length. In the sixth preferred embodiment, since there are no spacer blades 14 or 17 utilized, the entire compound perforating knife 27 has a height H. As with all the other informal perforating knives 18, 19, 22, 23 or 26 discussed above, the knife 27 has an overall base thickness D of twice "e" plus "d".

As has been alluded to previously, all of the compound perforating knives 18, 19, 22, 23, 26 and 27 discussed above are variants or exemplary embodiment of a number of compound knives that can be constructed using either a plurality of knife blades, a plurality of knife blades and one or more spacer blades, or a single knife blade and a plurality of spacer blades. The spacer blades and the knife blades can be arranged in whatever combination that is best suited for the paper web weight or thickness and the number of signatures in the multi-layer signature that is to be perforated. All of the compound perforating knives have their lower or second edge provided with a standard arrangement of recesses 6 and with a uniform base thickness D. This means that each compound perforating knife will be receivable in the receptacle of the perforating cylinder, such as the one depicted in European Patent Publication EPO 307891 B1. Each of the compound perforating knives has a plurality of signature perforating teeth 2, 11 or 13, or a combination thereof pointing out toward a counter-perforating cylinder. These teeth always project beyond any spacer blade or blades 14 or 17 used in the compound perforating knife because the height H of each knife blade is greater than the height "h" of each spacer blade. The maximum depth of penetration of the teeth into the signature is defined by the greater height H minus the lesser height "h". The individual knife blades and/or spacer blades are disposed next to each other in the circumferential direction of rotation of the perforating cylinder. All of the knife blades 1, 7 and 12, and the spacer blades 14 and 17 are made of the same material, such as, for example a hardened sheet steel. Any combination of knife blades and spacer blades can be arranged next to each other so long as the total thickness D is twice "e" plus "d".

The perforation of the multi-layer signature being printed and assembled is accomplished by the teeth of the selected compound perforating knife that is secured to the peripheral surface of a suitable perforating cylinder. The specific compound perforating knife will be assembled based on the characteristics of the particular paper web being printed and the number of layers of the multi-layer signature. When assembling the particular compound perforating knife, it is also possible to choose a particular perforation pattern by the appropriate arrangement of the positive and negative tooth blades of less than full cylinder width. In addition, the placement of a spacer blade as either the upstream or the downstream component of the compound blade will provide a perforation line of different characteristics. Since the circumferential lengths of different layer in the multi-layer signature are apt to be different, to provide a folded signature with uniform edges, it is important to be able to locate the perforation line at the correct location since signature folding will take place along the signature line.

While preferred embodiments of a compound signature perforating knife in accordance with the present invention have been set forth fully and completely hereinabove, it will be apparent to one of skill in the art that a number of changes in, for example, the type of paper web being printed, the type of printing press being used, the drive arrangement for the perforating cylinder and the like can be made without departing from the true spirit and scope of the present invention which is accordingly to be limited only by the following claims.

What is claimed:

1. A compound perforating knife receivable in a receptacle in a perforating knife cylinder, said compound perforating knife being useable to perforate a multi-layer signature prior to folding of the signature in a folding apparatus of a web-fed rotary printing press, said compound perforating knife having a constant base thickness, said constant base thickness compound perforating knife comprising at least one knife blade selected from first knife blades each having a first blade thickness, and second knife blades each having a second blade thickness, said first blade thickness being greater than said second blade thickness, and from spacer blades selected from first spacer blades each having said first blade thickness, and second spacer blades each having said second blade thickness, said constant base thickness compound perforating knife having a combined total of three of said selected knife blades and said selected spacer blades, to provide said constant base thickness of said compound perforating knife, said constant base thickness being twice said first blade thickness plus said second blade thickness, said constant base thickness compound perforating blade having at least one of said selected knife blades and less than three of said selected spacer blades, each of said knife blades having a first height and each of said spacer blades having a second height, said second height being less than said first height, said first height being sufficiently greater than said second height to allow only said selected knife blades to contact a multi-layer signature during perforation of said signature, and wherein said selected knife blades and said selected spacer blades are mounted in said receptacle to prevent relative movement between said selected knife blades and said selected spacer blades in said compound perforating knife.

2. The compound perforating knife of claim 1 wherein a first selected knife blade has a first length and further wherein second and third selected knife blades each have a second length, said second length of said second and third selected knife blades being one half of said first length and further wherein said second and third selected knife blades are arranged as a pair mirror reversed with respect to each other and having first blade ends abutting at a vertical centerline of said compound perforating knife, said second and third selected knife blades having a combined length equal to said first length of said first selected knife blade.

* * * * *